US008025426B2

(12) United States Patent
Mündle et al.

(10) Patent No.: US 8,025,426 B2
(45) Date of Patent: Sep. 27, 2011

(54) LUMINAIRE COMPRISING ELONGATE LIGHT SOURCE AND LIGHT-INFLUENCING ELEMENT

(75) Inventors: Anton Mündle, Satteins (AT); Gerald Ladstätter, Klaus (AT)

(73) Assignee: Zumtobel Lighting GmbH (AT)

( * ) Notice: Subject to any disclaimer, the term of this patent is extended or adjusted under 35 U.S.C. 154(b) by 352 days.

(21) Appl. No.: 11/816,193

(22) PCT Filed: Feb. 16, 2006

(86) PCT No.: PCT/EP2006/001424

§ 371 (c)(1),
(2), (4) Date: Nov. 30, 2007

(87) PCT Pub. No.: WO2006/087198

PCT Pub. Date: Aug. 24, 2006

(65) Prior Publication Data

US 2008/0273321 A1 Nov. 6, 2008

(30) Foreign Application Priority Data

Feb. 17, 2005 (DE) ..... 10 2005 007 347

(51) Int. Cl.
*F21S 8/00* (2006.01)

(52) U.S. Cl. ..... 362/281; 362/283; 362/306

(58) Field of Classification Search ..... 362/281, 362/283, 306

See application file for complete search history.

(56) References Cited

U.S. PATENT DOCUMENTS

| | | | | |
|---|---|---|---|---|
| 3,127,113 | A * | 3/1964 | Tomkinson | 362/17 |
| 4,333,127 | A * | 6/1982 | Alkema et al. | 362/17 |
| 4,991,070 | A | 2/1991 | Stob | |
| 6,543,912 | B1 * | 4/2003 | Simon | 362/327 |
| 7,465,070 | B2 * | 12/2008 | Engel | 362/297 |
| 2003/0026099 | A1 * | 2/2003 | Dutka et al. | 362/283 |

FOREIGN PATENT DOCUMENTS

| | | |
|---|---|---|
| DE | 77 27 830 | 2/1979 |
| DE | 199 11 347 A1 | 9/2000 |
| DE | 199 54 134 A1 | 5/2001 |
| DE | 101 51 958 A1 | 4/2003 |
| EP | 0 400 318 B1 | 11/1994 |

OTHER PUBLICATIONS

International Search Report for PCT/EP2006/001424. Mailed Apr. 13, 2006.

* cited by examiner

*Primary Examiner* — Diane Lee
*Assistant Examiner* — William Carter
(74) *Attorney, Agent, or Firm* — The H.T. Than Law Group

(57) ABSTRACT

Disclosed is a light (1) comprising means (3*a*) for retaining and electrically connecting at least one elongate light source (2) and a light-influencing element (10) which is located next to the light source (2) and is composed of several individual elements (15). Said elements (15) that form the light-influencing element (10) can be swiveled or rotated independently of each other about an axis that extends substantially parallel to the longitudinal axis of the light source (2).

11 Claims, 5 Drawing Sheets

LUMINAIRE COMPRISING ELONGATE LIGHT SOURCE AND LIGHT-INFLUENCING ELEMENT

FIELD OF THE INVENTION

The present invention relates to a luminaire according to the preamble of claim 1, said luminaire having means for holding and electrically connecting at least one elongate light source, and having a light-influencing element disposed next to the light source. In particular, the present invention relates to a luminaire in which a matrix arrangement, consisting of a plurality of so-called cell-matrix elements, is disposed in proximity to a light source, said matrix arrangement serving to take into a plurality of light beams the light emitted from the light source.

BACKGROUND OF THE INVENTION

A luminaire having the mentioned cell-matrix elements is known from, for example, DE 101 51 958 A1 of the applicant. The cell-matrix elements, which—viewed in the light radiation direction—are disposed in front of the light source, consist of a back reflector part which at least partially encompasses the light source and has a plurality of through-apertures, adjoining which are smaller, pot-type reflectors. The use of such cell-matrix elements allows the light emitted from the light source to be radiated individually via the pot reflectors, such that, when viewed as a whole, the impression is created of a multiplicity of small spotlights or spots disposed next to each other. The resource requirement for achieving this optically attractive effective is appreciably less than with the actual use of a multiplicity of individual spotlights.

There are also known luminaires of the company NORKA, in which an elongate light source is surrounded by a transparent lamp cover having an oval cross-section. The cover is rotatably mounted at its ends, such that the light radiation characteristic of the luminaires can be influenced to a certain degree by swivelling the cover. Such a luminaire is shown in, for example, DE 199 11 347 A1.

SUMMARY OF THE INVENTION

The present invention is based on the object, proceeding from the luminaire known from DE 101 51 958 A1, of specifying additional measures by which the luminous characteristics of the luminaire, and its application possibilities, are further improved.

The object is achieved by a luminaire having the features of the independent Claim 1. Advantageous developments of the invention constitute subject-matter of the sub-claims.

The main concept of the present invention consists in disposing the cell-matrix elements in or on the luminaire in such a way that they can be pivoted or rotated, independently of each other, about an axis running parallel to the longitudinal axis of the light source. The impression of the lamp having a plurality of individual spots is thereby further enhanced, since a typical feature of individual spotlights or spots is that they are adjustable, i.e. they can be rotated or pivoted. The measure according to the invention thus now creates the possibility of swivelling even in the case of a luminaire whose light source is constituted by, for example, an elongate fluorescent tube.

The present invention concept is not, however, limited to the swivelling of cell-matrix elements, but can be applied generally to so-called light-influencing elements by means of which the light emitted from a light source is to be influenced in any manner. It would also be conceivable, for example, for appropriate colour filters, hole meshes or other lighting modules to be disposed so as to be rotatable about a light source, to enable the light radiation characteristic of the luminaire as a whole to be influenced in a desired manner.

There is accordingly proposed, according to the invention, a luminaire comprising means for holding and electrically connecting at least one elongate light source, and comprising a light-influencing element which is disposed next to the light source and which is constituted by a plurality of individual elements, the individual elements constituting the light-influencing element being capable of being pivoted or rotated, independently of each other, about an axis running substantially parallel to the longitudinal axis of the light source.

Developments of the invention relate, in particular, to measures for pivotally mounting the individual elements constituting the light-influencing element. There is preferably provided in this connection a mounting part, for holding the light-influencing element, such that the light-influencing element or the individual elements can be, for example, slipped or snapped onto said mounting part. There is now also the possibility of making the mounting part itself rotatable, with the result that the light-influencing element—for example consisting of individual cell-matrix elements—can be swivelled or rotated as a whole. In addition thereto, however, provision is also made for the individual elements constituting the light-influencing element to be themselves rotatably mounted on the mounting part. For this purpose, the mounting part is preferably cylindrical or at least cylinder-like in design, such that the individual elements can be easily swivelled independently of each other.

The mounting part is preferably constituted by a translucent, transparent element surrounding the light source at a distance. This element may be, for example, a so-called protective tube for luminaires of a higher protection class, since this protective tube fulfils the stated requirements very well. Such a tube is known from, for example, EP 0 400 318 B1 of the applicant. Such protective tubes are available in large quantities, and can be produced inexpensively.

The individual elements of the light-influencing element can then be clipped onto this cylindrical or cylinder-like design protective tube, for example in the form of larger cell-matrix modules or as individual cells. The clip connection allows the light-influencing element, or its parts, to rotate freely about, for example, 180°. Since the protective tube is translucent over its entire circumference, the light emitted from the light source can enter the light-influencing element, via the protective tube, in any position of the light-influencing element. The protective tube used as a mounting part can be held by, for example, a device carrier or a side arm, and—as already mentioned—can also be rotatably disposed thereon.

A further advantageous development of the invention consists in there being provided between the light-influencing element and the carrier element a type of arresting connection by means of which rotation is allowed only in certain angular ranges or in certain steps. This creates the possibility whereby the swivelling or rotation of the light-influencing element or of the individual elements are rendered reproducible. In this case, additionally, a scaling may be provided, by means of which the individual elements can be swivelled easily to a desired value.

The possibilities stated hitherto for mounting the light-influencing element in a pivotable manner according to the invention have consisted in using a separate carrier element—for example, in the form of the transparent protective tube—on which the light-influencing element is disposed. It would also be conceivable, however, to use the light source, thus, for example, the fluorescent tube itself, as a carrier element. Since a maximum permissible load is specified for the individual lamps, it would have to be ensured in this case that the light-influencing element is sufficiently light and that excessively high forces do not occur during swivelling or rotation.

Otherwise, the previously mentioned mounting of the light-influencing element on a transparent mounting part also offers advantages if a single-piece light-influencing element is used, since in this case a particularly simple pivotable mounting is achieved. According to a second aspect of the present invention, there is therefore also proposed according to the invention, a luminaire comprising means for holding and electrically connecting at least one elongate light source, and comprising a light-influencing element which is disposed next to the light source and which is capable of being pivoted or rotated about an axis running substantially parallel to the longitudinal axis of the light source, the light-influencing element being, according to the invention, pivotally or rotatably disposed on a cylinder-like mounting part, which is translucent. In this case, likewise, according to an advantageous development of the invention provision may be made for the use of arresting elements, in order to define preferred positions for the light-influencing element.

Viewed as a whole, the present invention thus creates the possibility of orienting light-influencing elements in any manner in respect of an elongate light source. If cell matrices having individual reflectors are used as light-influencing elements, effects can be achieved, in respect of the variability of the light radiation characteristic of the luminaire, which hitherto have existed only with the use of a multiplicity of individual spots.

BRIEF DESCRIPTION OF THE DRAWINGS

The invention is to be described more fully in the following with reference to the accompanying drawing, wherein.

DETAILED DESCRIPTION OF THE INVENTION

Figure 1:
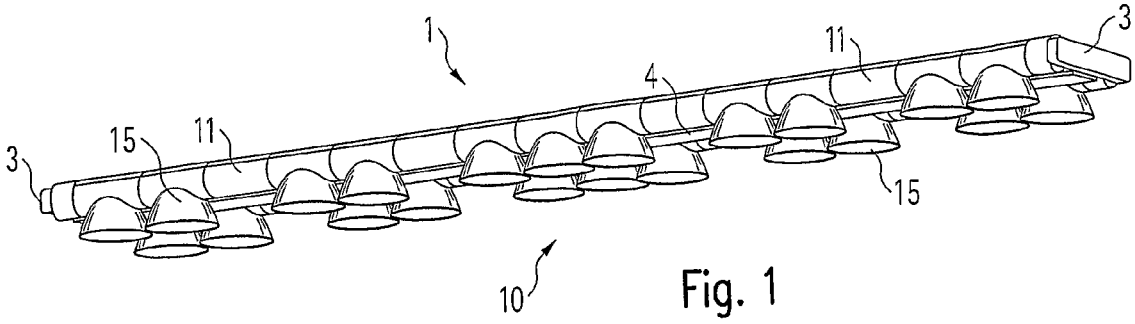
FIG. 1 shows a perspective view of an exemplary embodiment of a luminaire according to the invention.
Figure 2:
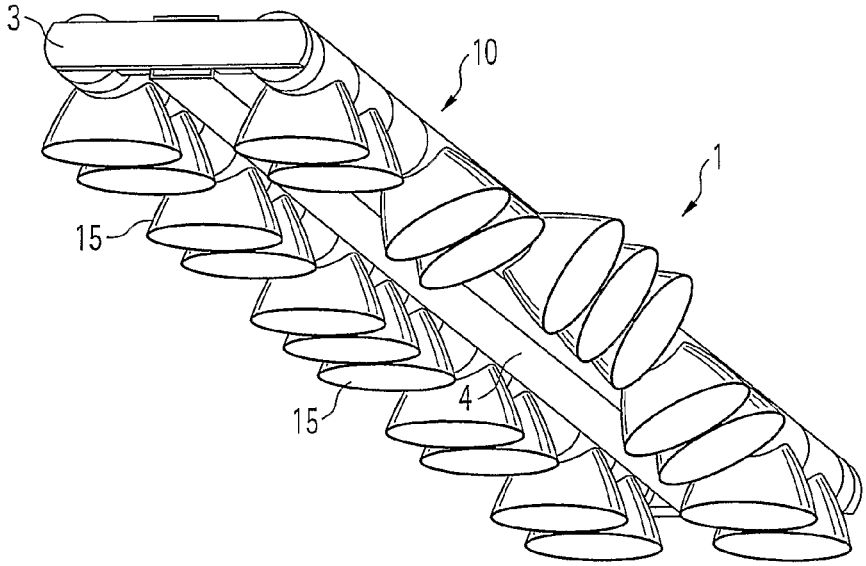
FIG. 2 shows a further view of the luminaire of FIG. 1 according to the invention.
Figure 3:
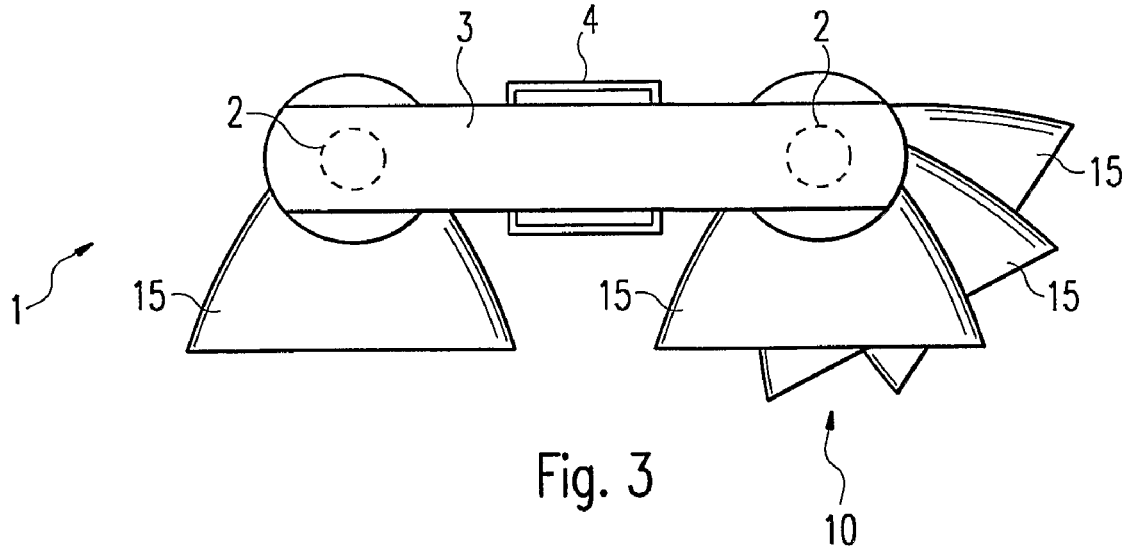
FIG. 3 shows an end view of the luminaire according to the invention.
Figure 5:
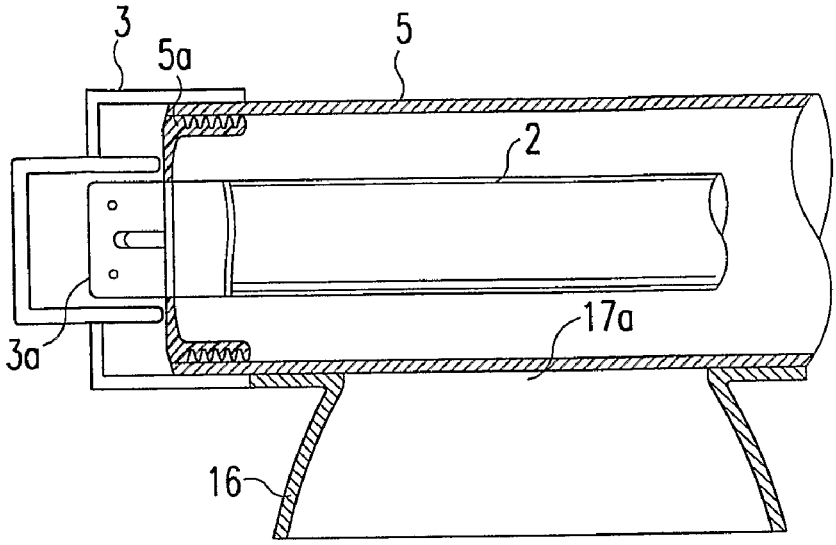
FIG. 5 shows a lateral sectional representation of the end region of the luminaire.
Figure 6:
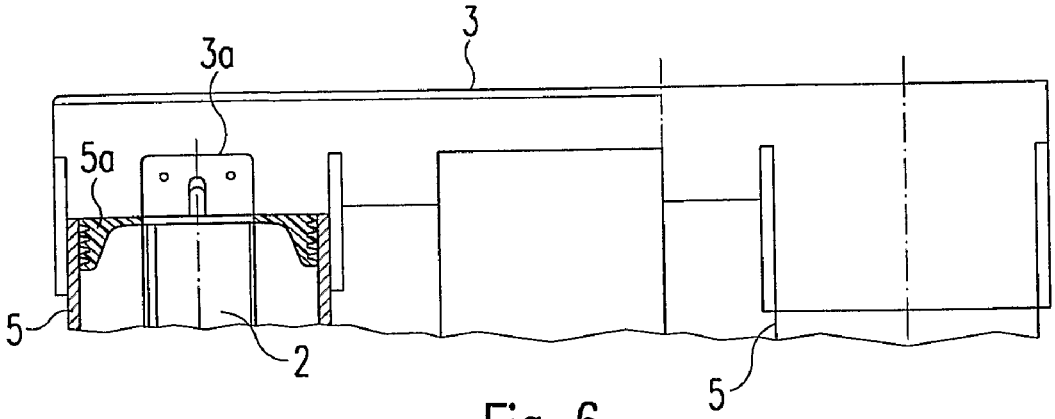
FIG. 6 shows, in a top view, a partial section of the end region of the luminaire.

The exemplary embodiment of a luminaire 1 according to the invention, represented in FIGS. 1 to 3, has two elongate light sources 2 in the form of fluorescent tubes, which are disposed in parallel to each other and are held at their ends in respective holders—represented in FIGS. 5 and 6—which are disposed at two end parts 3 of the luminaire 1. In the present exemplary embodiment there also extends between the two light sources 2, and in parallel thereto, a central carrier 4, which has a quadrate cross-section and which can be used, for example, for the disposition of operational equipment for the two fluorescent lamps 2. For example, electronic ballasts for controlling the fluorescent lamps 2 could be disposed within this carrier 4.

The light emitted from the two fluorescent lamps 2 is radiated via a matrix arrangement denoted in general by the reference 10. In the present case, this matrix arrangement 10 is constituted by a plurality of cell-matrix elements 15, the design of which can be seen from FIG. 4. According to this representation, a single matrix element 15 consists firstly of a pot-type reflector 16 which adjoins a back reflector 17, this back reflector having an approximately semicircular cross-section and at least partially surrounding the lamp 2. The back reflector 17 has a through-aperture 17*a*—as represented in FIG. 5—adjoined by the pot reflector 16 which, in turn, has an approximately circular light outlet aperture 18 on its underside. Cell-matrix elements of this type are known from, for example, DE 101 51 958 A1 of the applicant already mentioned above. The particularity of these elements is that they emit the light of a single light source in the form of a plurality of beams, such that the impression is created of a multiplicity of light spots disposed next to each other.

As can be seen from, for example, the representation in FIG. 1, in the case of the luminaire 1 shown respectively ten cell-matrix elements 15 are provided for each fluorescent lamp 2, said cell-matrix elements each having a single pot reflector 16. These cell-matrix elements 15 are disposed such that at least some are spaced apart from each other, the clearance between two elements in this case then being spanned by a tubular, or in cross-section at least semicircular, covering part 11, which is opaque. It is thereby ensured that light is emitted towards the underside only via the pot reflectors 16 of the cell-matrix elements 15. As an alternative to the represented cell-matrix elements 15 with individual reflectors, it would also be possible—as known from DE 101 51 958 A1—to use modules having a plurality of pot reflectors disposed adjacently to each other.

A particularity of the luminaire 1 according to the invention consists in that—as represented in FIGS. 2 and 3—the individual cell-matrix elements 15 are not fixed on the luminaire 1 in a certain alignment, but instead can be swivelled or rotated in a certain angular range. In particular, it is possible for the cell-matrix elements 15 to be swivelled about an axis lying in parallel to the lamps 2, such that the individual elements 15 can be aligned independently of each other in a desired manner. This pivot axis or rotary axis preferably coincides approximately with the longitudinal axis of the corresponding light source 2. Hitherto, this possibility of swivelling has existed only with the use of individual light spots.

Figure 4:
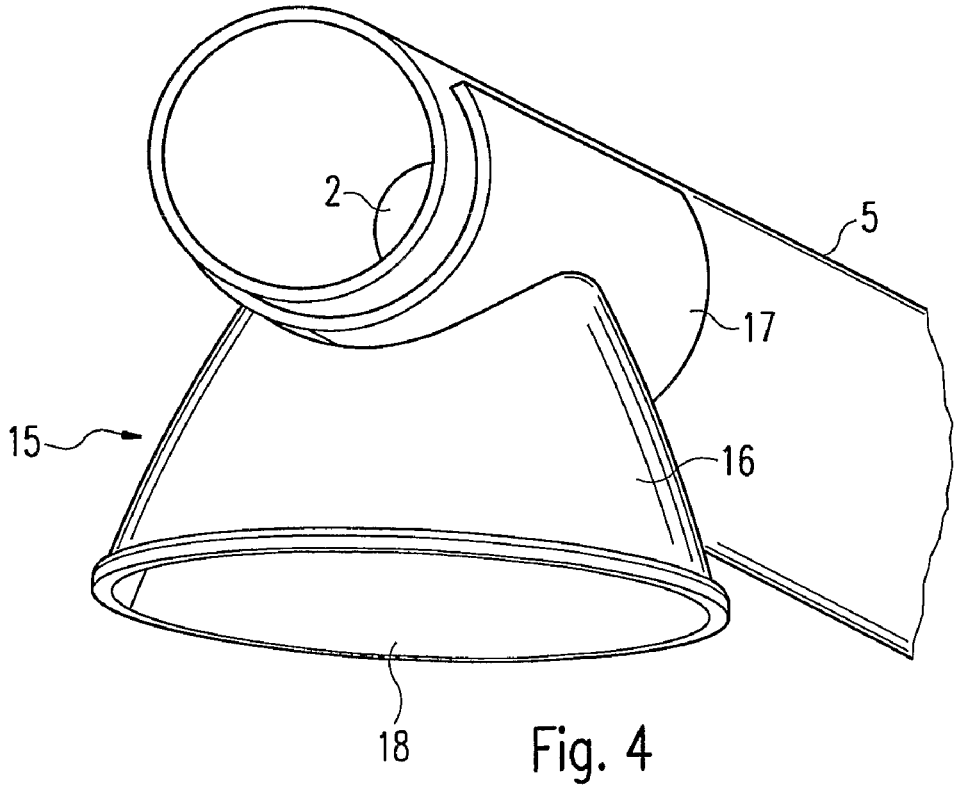
FIG. 4 shows a perspective view of the disposition of an individual cell-matrix element on a mounting part.
Figure 7:
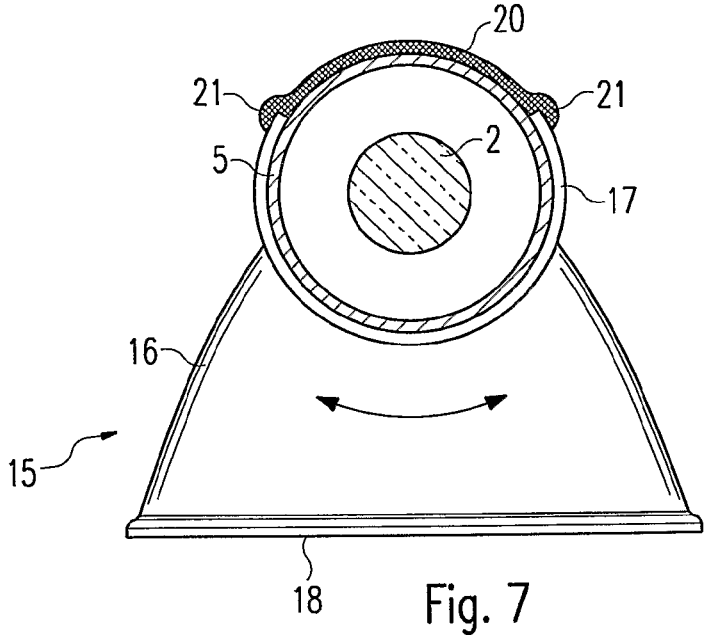
FIG. 7 shows the arrangement of a cell-matrix element on a mounting part, according to a first variant.

The swivelling, according to the invention, of the cell-matrix elements 15 is rendered possible by a special mounting of said elements on the luminaire 1, which mounting is now to be explained more fully with reference to FIGS. 4, 5 and 7.

The special nature of the mounting of the cell-matrix elements 15 consists in that these elements are held on a separate mounting part 5, which surrounds the light source 2 at a distance and which is transparent to the emitted light beams. This bearing part 5 may be, for example, a transparent plastic tube made of plastic, such as that hitherto provided only for use with luminaires of a higher protection class. According to the representation in FIG. 5, the protective tube 5 is held in the end parts 3 of the luminaire 1, the rotation of the lamp, and thus the fitting and removal of same, being rendered possible by means of a special collar 5*a*.

As can be seen from, in particular, the sectional representation in FIG. 7, a cell-matrix element 15, with the semicircular or partially cylinder-like back reflector 17 is snapped onto the carrier part 5, and it can then be swivelled in any manner about the longitudinal axis of the lamp 2, according to the representation. In this case, the back reflector 17 thus also serves as a holding part for the cell-matrix element 15. Since the protective tube 5 has a cylindrical exterior, it is ensured that, in each position of the cell-matrix element 15, light falls through the through-aperture 17*a* of the back reflector 17 and can be emitted via the pot reflector 16. Although no spot lamp is used, it is thereby ensured that a focussed light is actually radiated in the desired direction via the cell-matrix element 15.

As can also be seen from the representation in FIGS. 4 and 7, a particularity of the back reflector 17 of the represented cell-matrix element 15 consists in that the back reflector 17 has an aperture on its top side, and thus does not constitute a closed hollow cylinder. Since the back reflector 17 is flexible at least to a certain degree, the result is that the cell-matrix element 15 can be snapped laterally onto the protective tube 5 in a simple manner. This thus renders possible particularly simple mounting of the cell-matrix elements 15.

An alternative embodiment thereto would consist in the back reflector 17, or the correspondingly used holding part, being completely closed, i.e. having the form of a hollow cylinder as viewed in cross-section, just like the protective tube 5. In this case, simple lateral snapping onto the protective tube 5 would no longer be possible. Instead, the individual cell-matrix elements 15 would have to be threaded onto the protective tube 5 from the end, before said protective tube is finally disposed on the luminaire. An advantage of this solution, however, would be that light is no longer radiated in a direction opposite to the pot reflectors 16. Although this is sometimes desired in those cases in which the pot reflectors 16 are directed vertically downwards, as soon as the cell-matrix elements 15 are swivelled, however, light should no longer be radiated in a direction opposite to the pot reflectors 16.

The radiating of light in a direction opposite to the pot reflectors 16 could also be prevented, however, by an alternative solution, which is represented in FIG. 7. In this exemplary embodiment, the back reflector 17 is not completely closed, as is also the case in FIGS. 4 and 5. Instead, the portion of the back reflector 17 that is still open is now spanned by an additional, top reflector 20, which has the form of an arc in cross-section and is reflective or at least opaque. This top reflector 20 can be mounted after the cell-matrix element 15 has been snapped onto the carrier part 5, and for this purpose it has two clamping parts 21, at its two ends respectively, by means of which the top reflector can be snapped onto the back reflector 17. In this case, when the cell-matrix element 15 is swivelled the top reflector 20 is also rotated at the same time.

In the case of the embodiments according to FIGS. 4 to 7, the mounting part 5 has a smooth outer surface, such that the cell-matrix elements 15 can be swivelled steplessly in any manner. It is frequently desired, however, that the swivelling of the light-influencing elements be reproducible, in order that alignment of the individual elements can be effected in a uniform manner. This possibility is created by a variant in respect of the mounting of the cell-matrix elements 15, which is represented in FIGS. 8 and 8*a*.

In the case of this variant, the outer surface of the mounting part 5 is not completely smooth, but instead has a knob-type outward convexity 6 at a certain location. Disposed on the inside of the pot reflector 17, in turn, are a plurality of recesses 19 or slots, in which the outward convexity 6 of the mounting part 5 can engage. This measure creates preferred positions, provided at certain angular intervals, into which the cell-matrix element 15 can be rotated and engaged with the mounting part 5. Reproducible setting of the various elements is thereby simplified substantially. In addition thereto, the cell-matrix element 15 could furthermore be provided with a scale or scaling by means of which the current angular position can be read off, such that uniform alignment of the elements is simplified further. This scaling could, of course, also be used in the variant according to FIG. 6, in which provision is made for stepless rotation of the cell-matrix elements 15.

Figure 8:
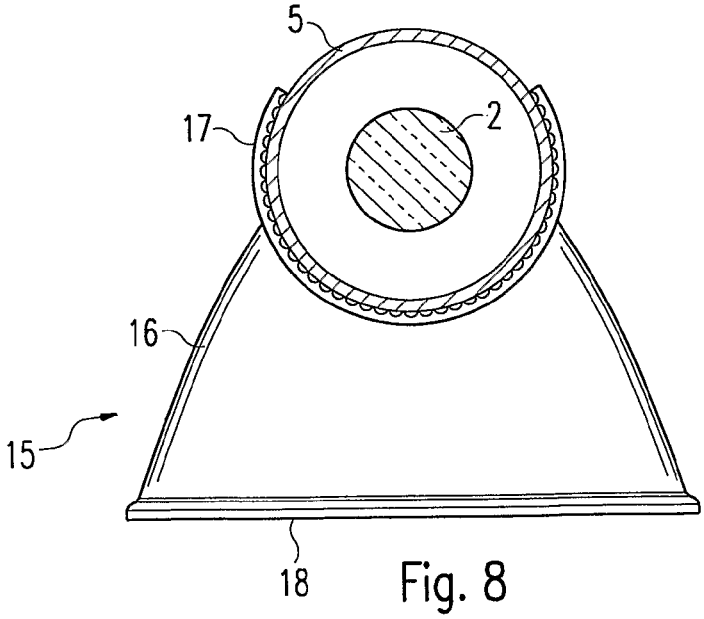
FIG. 8 shows a further variant for the mounting, according to the invention, of a cell-matrix element on a mounting part.
Figure 8A:
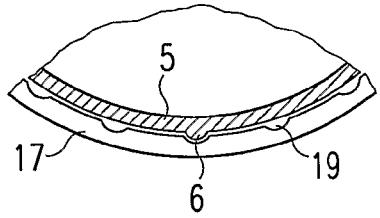
FIG. 8*a* shows a detail of the exemplary embodiment represented in FIG. 8.
Figure 9:
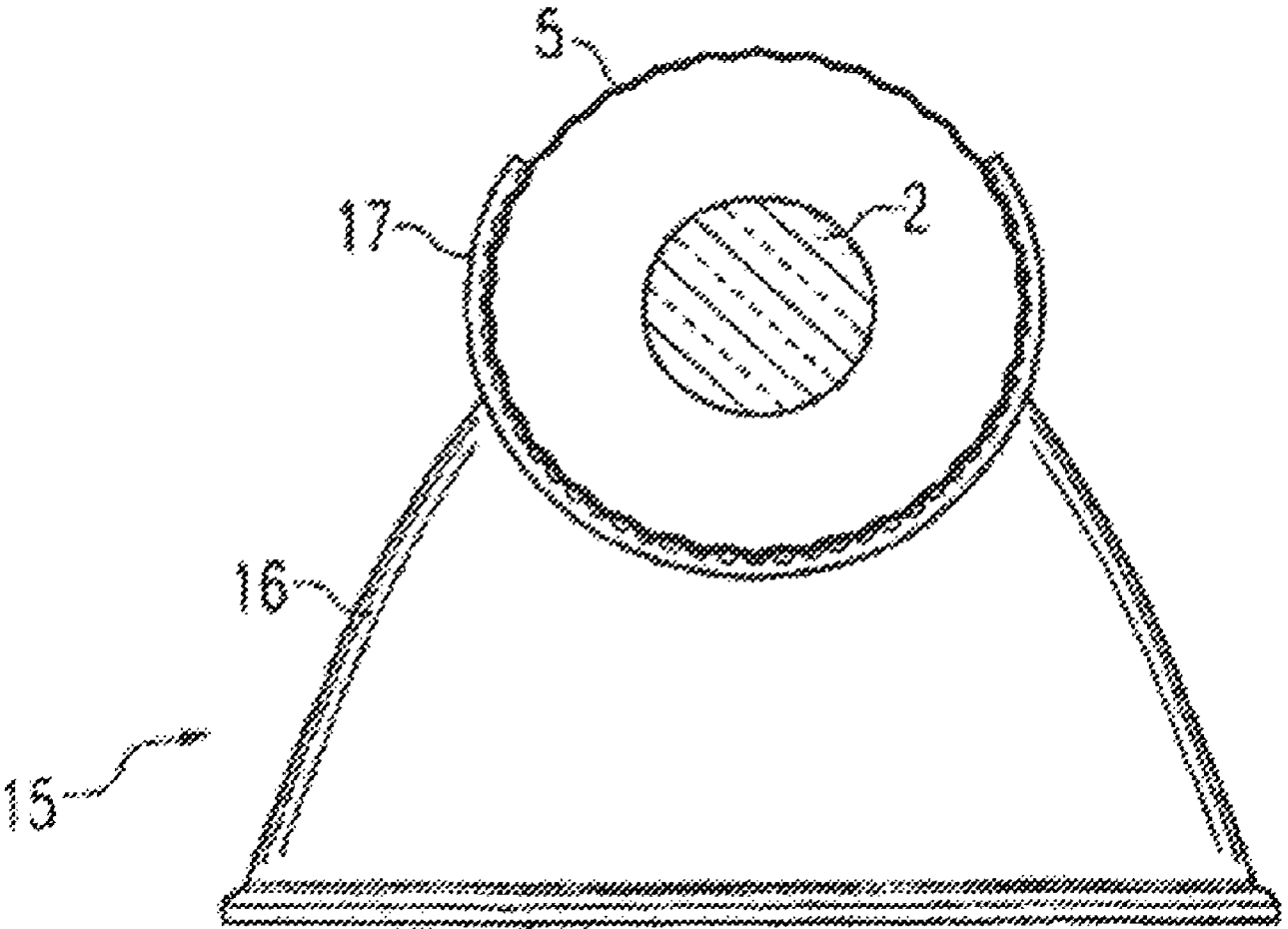
FIG. 9 shows another variant for the mounting, according to the invention, of a cell-matrix element on a poloygonal mounting part.

It is to be noted that the stepped rotation of the cell-matrix elements provided for in the case of the exemplary embodiment according to FIGS. 8 and 8*a* could also be achieved if the carrier part 5 is not completely cylindrical in form, but is instead, for example, only cylinder-like, in the form of a polygon. In this case, likewise, stepwise rotation of the cell-matrix elements could be ensured with a corresponding design of the back reflector 17 or of the holding part for the light-influencing element.

In the case of the exemplary embodiments described hitherto, provision has been made whereby each of the cell-matrix elements can be adjusted separately and individually relative to the transparent mounting part. It would also be conceivable, however, to provide for swivelling of the entire arrangement, for which purpose, instead of the cell-matrix elements separately, the entire mounting part can be rotated about the longitudinal axis of the light source. This measure, which may be provided as an alternative or in addition to individual swivelling of the cell-matrix elements, could enable the various parts of the light-influencing element to be adjusted uniformly in a simple manner.

A further conceivable variant would be to dispense entirely with the mounting part in the form of a separate transparent protective tube, and to use instead the tubes of the fluorescent lamp itself as a mounting part. In this case, however, it would have to be ensured that the loads are not too great for the lamp, since otherwise there would be a risk of damaging the lamp. Accordingly, the mounted light-influencing elements should be of only a low weight, and the forces occurring during rotation must not be too high.

In the case of the exemplary embodiments represented, the mounting part for the cell-matrix elements has always been disposed concentrically relative to the light source, such that the pivot axis or rotational axis coincided with the longitudinal axis of the light source. It would also be possible, however, for the light source to be disposed rather in the lower region of the protective tube and, accordingly, for the pivot axis to be displaced somewhat relative to the lamp axis. In particular, disposing the light centre in the proximity of the back reflectors of the cell-matrix elements would even be advantageous in this connection.

In conclusion, it must also be pointed out that, instead of the cell-matrix elements represented, other light-influencing elements could also be pivotally or rotatably disposed on a luminaire in a manner according to the invention. Also conceivable, for example, would be the use of certain colour filters or perforated plates. In these cases, likewise, the possibility of swivelling offers additional advantages, since the light output of the luminaire can be influenced in a desired manner.

The invention claimed is:

1. A luminaire comprising at least one elongate light source (2), and a light-influencing element (10) which is disposed proximate the light source (2) and comprises a plurality of individual elements (15), wherein the individual elements (15) are snapped or slipped mounted onto a cylindrical, translucent mounting part (5), which surrounds the light source (2) and is positioned at a distance from the light source (2), wherein the mounting part (5) has a cylindrical outer surface, and wherein the individual elements (15) are capable of being pivoted or rotated, independently of each other, around the cylindrical, translucent mounting part (5) and about an axis substantially parallel to a longitudinal axis of the light source (2), wherein cooperating arresting elements (6, 19), for defining preferred positions for the light-influencing element (10), are disposed on the mounting part (5) and on the individual elements (15).

2. The luminaire according to claim 1, wherein a pivot axis or rotary axis for the individual elements (15) coincides substantially with the longitudinal axis of the light source (2) or is displaced relative to said longitudinal axis of the light source (2).

3. The luminaire according to claim 1, wherein the mounting part (5) is constituted by a transparent plastic tube.

4. The luminaire according to claim 1, wherein the mounting part (5) is polygonal in cross-section.

5. The luminaire according to claim 1, wherein the mounting part (5) is rotatably attached to the luminaire (1).

6. The luminaire according to claim 1, wherein the light-influencing element (10) is constituted by a matrix arrangement (10).

7. The luminaire according to claim 6, wherein the individual elements (15) are arranged in the matrix arrangement (10), wherein each individual element (15) comprises a back reflector (17) which faces towards the light source and which has a through-aperture (17*a*) adjoined by a pot reflector (16).

8. The luminaire according to claim 7, wherein the pot reflector (16) has a circular light output aperture (18).

9. A luminaire (1) comprising at least one elongate light source (2), and comprising a light-influencing element (10) which is disposed proximate the light source (2) and which is capable of being pivoted or rotated about an axis running substantially parallel to a longitudinal axis of the light source (2), wherein the light-influencing element (10) is snapped or slipped onto a cylindrical mounting part (5), which is translucent and surrounds the light source (2) at a distance, so as to be pivotally or rotatably disposed thereon, wherein the mounting part (5) has a cylindrical outer surface and wherein cooperating arresting elements (6, 19), for defining preferred positions for the light-influencing element (10), are disposed on the mounting part (5) and on the light-influencing element (10).

10. The luminaire according to claim 9, wherein the mounting part (5) is constituted by a transparent plastic tube.

11. The luminaire according to claim 9, wherein the mounting part (5) is polygonal in cross-section.

* * * * *